United States Patent [19]

Ikeura

[11] 4,117,815

[45] Oct. 3, 1978

[54] CLOSED-LOOP MIXTURE CONTROL SYSTEM FOR INTERNAL COMBUSTION ENGINE USING ERROR-CORRECTED EXHAUST COMPOSITION SENSORS

[75] Inventor: Kenji Ikeura, Yokosuka, Japan

[73] Assignee: Nissan Motor Company, Limited, Yokohama, Japan

[21] Appl. No.: 676,480

[22] Filed: Apr. 13, 1976

[30] Foreign Application Priority Data

| | | | |
|---|---|---|---|
| Apr. 22, 1975 | [JP] | Japan | 50-48200 |
| Apr. 30, 1975 | [JP] | Japan | 50-51562 |
| Jun. 24, 1975 | [JP] | Japan | 50-88311[U] |

[51] Int. Cl.[2] ..... F02M 7/00

[52] U.S. Cl. ..... 123/119 EC; 123/32 EE; 60/276; 60/289; 73/23

[58] Field of Search ..... 123/32 EE, 119 EC; 60/276, 285; 23/254 E; 73/23

[56] References Cited

U.S. PATENT DOCUMENTS

| | | | |
|---|---|---|---|
| 3,674,436 | 7/1972 | Geul | 23/254 E |
| 3,745,768 | 7/1973 | Zechnall et al. | 123/32 EE |
| 3,926,154 | 12/1975 | Williams | 123/32 EE |
| 3,939,654 | 2/1976 | Creps | 60/285 |

*Primary Examiner*—Charles J. Myhre
*Assistant Examiner*—Andrew M. Dolinar
*Attorney, Agent, or Firm*—Lowe, King, Price & Becker

[57] ABSTRACT

A closed-loop mixture control system for an internal combustion engine comprises two exhaust composition sensors having different output characteristic curves that intersect at a point corresponding to the stoichiometric air-fuel ratio at which catalytic converters operate at a maximum conversion efficiency. The outputs from the two sensors are used to generate a signal which is substantially free from error introduced to the sensors due to varying external conditions.

14 Claims, 14 Drawing Figures

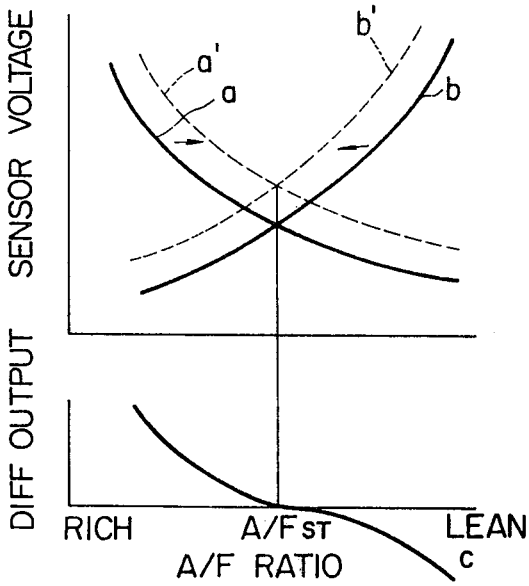
FIG. 7a
FIG. 7b
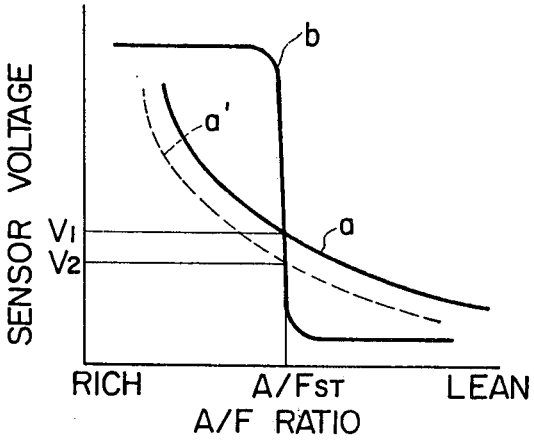
FIG. 8
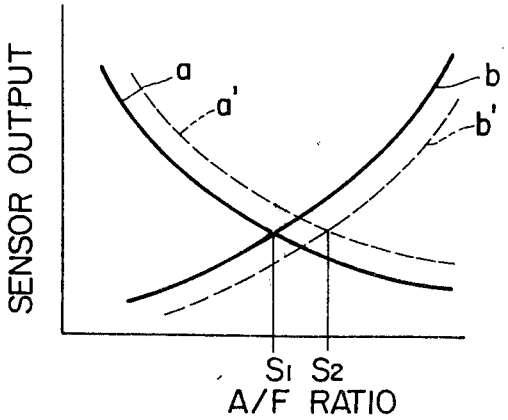
FIG. 10

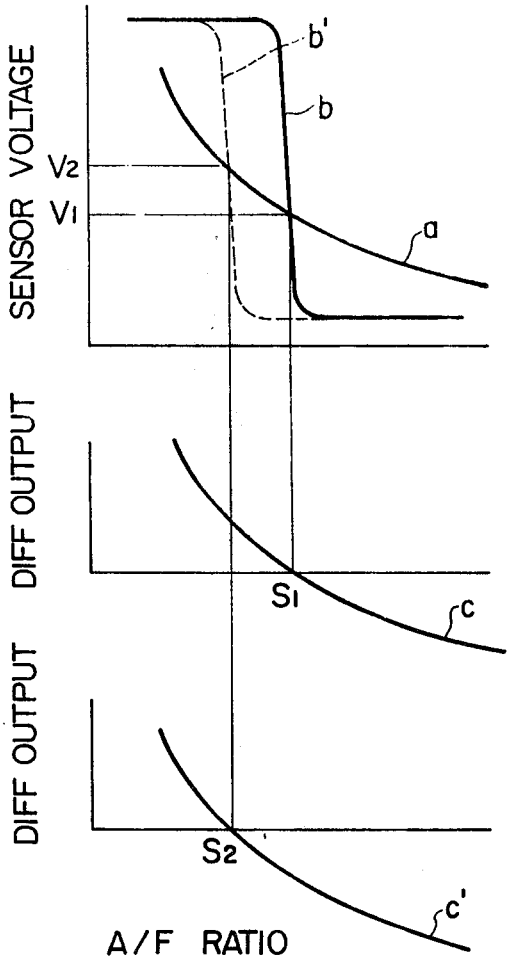
FIG. 9a
FIG. 9b
FIG. 9c
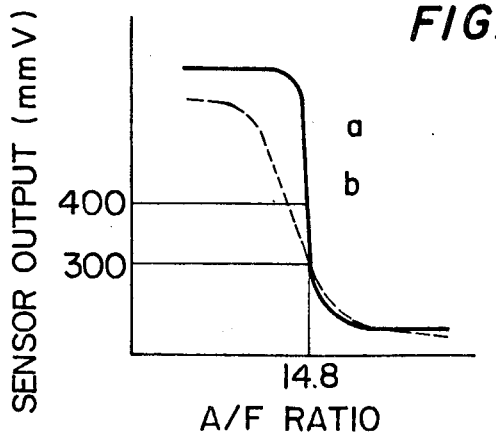
FIG. 11

CLOSED-LOOP MIXTURE CONTROL SYSTEM FOR INTERNAL COMBUSTION ENGINE USING ERROR-CORRECTED EXHAUST COMPOSITION SENSORS

The present invention relates to a closed-loop mixture control system for an internal combustion engine using error-corrected exhaust composition sensors.

In a closed-loop mixture control system, an exhaust composition sensor is provided to generate an electrical signal representing the concentration of a particular composition of the exhaust gases to control air-fuel ratios within a narrow range near stoichiometry at which the catalytic converter operates at the maximum conversion efficiency. However, the performance characteristic of the sensor tends to change with different temperatures and its operating time period.

An object of the invention is to compensate for the error introduced to an exhaust composition sensor due to temperature variations and its operating time period.

According to the invention, there is provided a mixture control system for an internal combustion engine, comprising first and second exhaust composition sensors having different output characteristics, but having a common output level at a predetermined air-fuel ratio of the mixture, means associated with the first and second sensors to generate a signal which is free from an error arising from a change in performance characteristic of the first and second sensors, and control circuit means for modulating the signal into a form suitable for controlling the air-fuel ratio of the mixture at the predetermined value.

According to a first preferred form of the invention, the first exhaust composition sensor has an increasing output characteristic with increases in the air-fuel ratio, while the second sensor has a decreasing output characteristic with the increases in the air-fuel ratio. The first and second sensors have a further tendency to change with external conditions in opposite directions. A comparator is provided to generate an output representing the difference between the outputs from the first and second sensors. The outputs from the sensors are so adjusted that they have a common output level at the predetermined air-fuel ratio, so that the comparator output is zero at the predetermined ratio. A substantially error-free signal is obtained from the comparator as any deviations from the intended value have a tendency to cancel each other due to the opposing characteristics of first and second sensors.

According to a second preferred form of the invention, the first sensor has a gradually changing output characteristic, while the second sensor has a rapidly changing output characteristic with a common output level at the predetermined air-fuel ratio. A sample and hold circuit is provided to sample an output from the first sensor when the second sensor rapidly changes its output level. The sampled output is stored for comparison with the instantaneous level of the output from the first sensor.

According to a further feature of the invention, the first and second exhaust composition sensors respectively are connected to error compensating potentiometers which are in turn operatively connected to a time of use measuring or indicating device, such as an odometer. The connection between the potentiometers and the odometer is such that the movement of the wipers of the potentiometers over their respective resistive elements is closely related to change in performance characteristic of the associated sensors so that any errors introduced thereto may be compensated.

The invention will be further described by way of example in conjunction with the accompanying drawings, in which.

Figure 1:
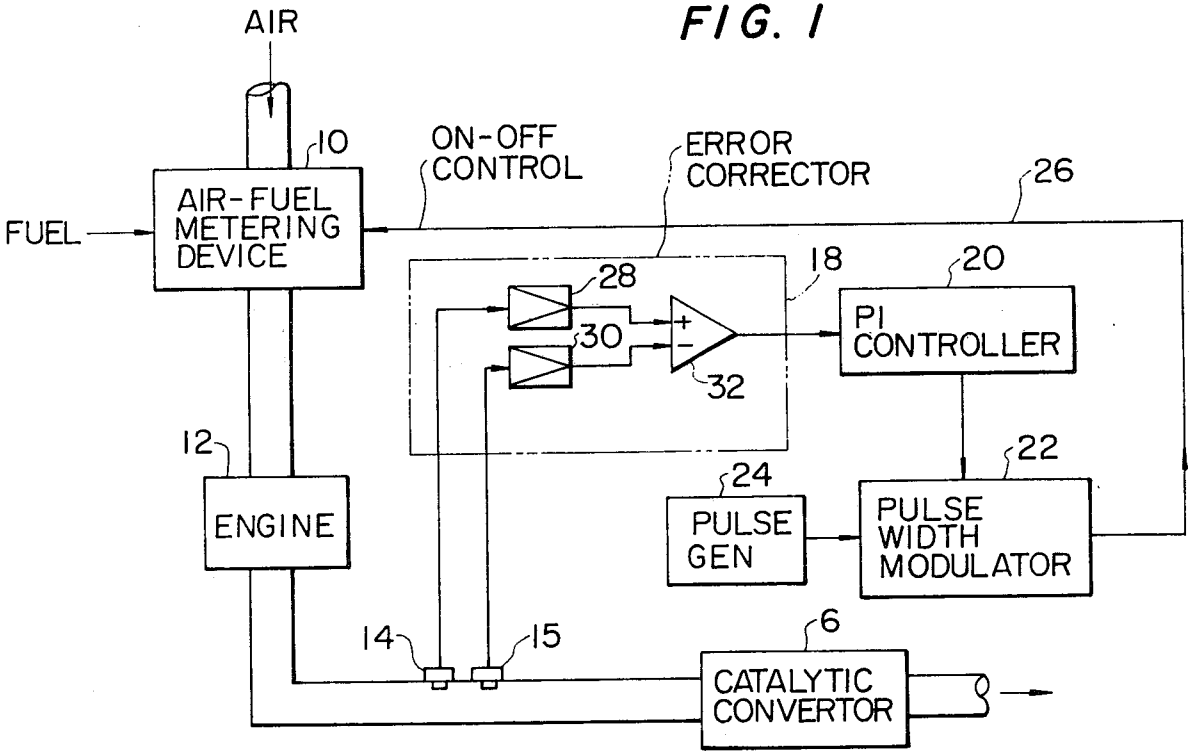
FIG. 1 is a schematic circuit of the first preferred embodiment of the invention.
Figure 2:
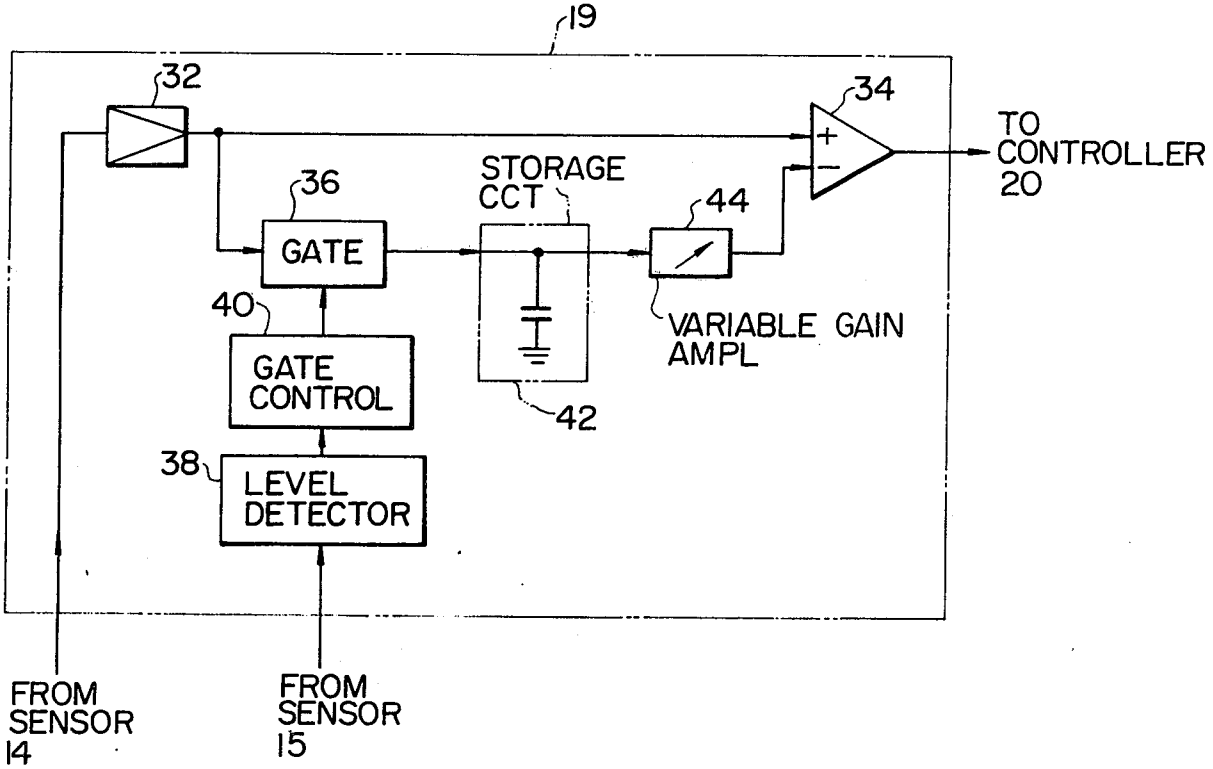
FIG. 2 is a schematic circuit of the second preferred embodiment of the invention.
Figure 3:
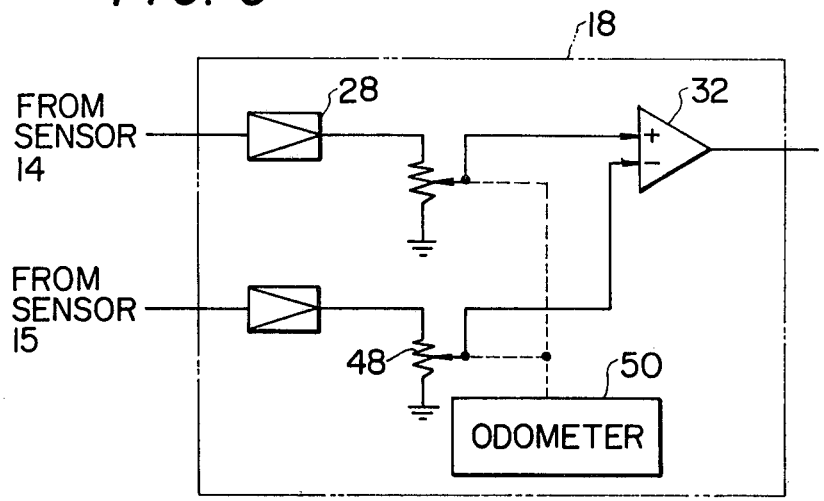
FIG. 3 is an illustration of a modification of the first embodiment of FIG. 1.
Figure 4:
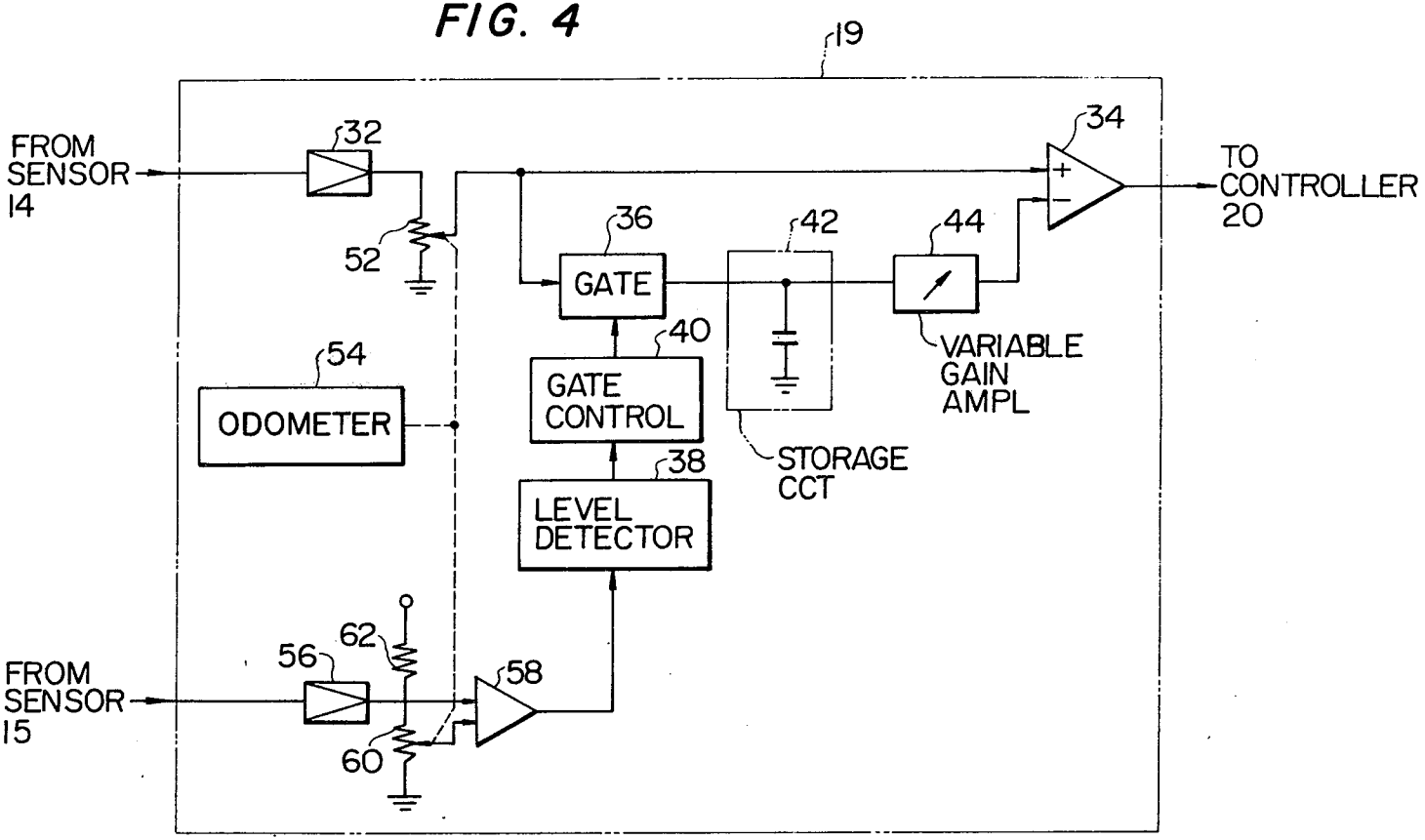
FIG. 4 is an illustration of a modification of the second embodiment of FIG. 2.

FIGS. *7a* and *7b* are graphs showing the output characteristics of the exhaust composition sensors of FIG. 1;

FIGS. 8 and 9 are graphs useful for explanation of the FIG. 2 embodiment;

FIG. 10 is a graph illustrating the output characteristics of the sensors of FIG. 3; and FIG. 11 is a graph useful for describing the FIG. 4 embodiment.

Referring now to FIG. 1, a closed-loop controlled air-fuel mixture control system of the invention is schematically shown. The system generally comprises an air-fuel metering device 10 which may be of fuel injection type or on-off controlled carburetion system associated with an internal combustion engine 12, exhaust composition sensors 14 and 14 provided at the exhaust passage of the engine, and a catalytic converter 6. An error corrector 18 of the invention is connected to the sensors 14 and 15 to provide a signal which is substantially free from temperature variations affecting the performance of the sensors. A conventional proportional-integral (PI) controller 20 is provided to modulate the amplitude of the output from the error corrector 18 in accordance with predetermined amplification characteristics to provide proportional and integral compensation; the output of controller 20 is fed to a pulse width modulator 22. A pulse generator 24 supplies the pulse width modulator 22 with a train of pulses at a predetermined frequency to modulate the width of the pulses in accordance with the controller output voltage. The modulator output is fed to the metering device 10 through line 26 to control the air-fuel ratio in proportion to the width of the applied pulse.

In accordance with a first embodiment of the invention, the composition sensor 14 is adapted to detect the oxygen concentration of the exhaust emissons and provides an output having a decreasing characteristic with an increase in the air-fuel ratio as shown by curve *a* of FIG. *7a,* while the sensor 15 is adapted to detect the carbon monoxide or hydrocarbon concentration to provide an increasing voltage output characteristic with an increase in the air-fuel ratio as shown in curve *b;* FIG. *7a* clearly indicates that the slopes have values that are on the same order of magnitude in the region where curves *a* and *b* intersect. The voltage outputs from sensors 14 and 15 are applied to variable gain amplifiers 28 and 30 respectively and to the noninverting and inverting input terminals of a differential amplifier 32 of the error corrector 18. The amplifier 32 generates an output which represents the difference between the two sensed voltages. The respective gains of the amplifiers 28 and 30 are so adjusted that the curves *a* and *b* intersect at a point corresponding to a predetermined air-fuel ratio at which the catalytic converter 16 operates at the maximum conversion efficiency. The differential amplifier 32 delivers an output which is positive during the time the sensor 14 output is greater than the sensor 15 output and negative after this voltage relation is reversed, as illustrated in FIG. 7*b*. The difference output from the amplifier 32 is fed to the PI controller 20 which increases and decreases the width of the control pulse when the input to the controller is respectively positive and negative. Correspondingly, the air-fuel ratio is increased and decreased for positive and negative inputs to controller 20. It will be appreciated that if the sensors 14 and 15 have a tendency to vary their outputs in opposite directions due to temperature variations as shown in curves *a'* and *b'*, the temperature variations are cancelled at the output of differential amplifier 32 (curve *c*) and have no influence on the amplifier output voltage.

In accordance with a second embodiment of the invention, both sensors 14 and 15 are adapted to detect the oxygen concentration of the exhaust gases with different output characteristics as shown in FIG. 8. The sensor 14 provides an output having a gradually decreasing characteristic with an increase in the air-fuel ratio (curve *a*), while the sensor 15 provides an output having a rapidly changing characteristic (curve *b*) at a predetermined air-fuel ratio which gives a maximum efficiency to the catalytic converter 16. These curves intersect at a point which corresponds to the predetermined air-fuel ratio and gives an output voltage $V_1$. In FIG. 2 the output voltage from the sensor 14 is amplified at 32 of an error corrector 19 and applied to the noninverting input terminal of a differential amplifier 34, and at the same time to an analog switch or transmission gate 36. On the other hand, the output voltage from the sensor 15 is fed to a level detector 38. This level detector produces an output when the sensor 15 output has a sharp transition at the predetermined air-fuel ratio. A gate control circuit 40 generates a gate control pulse for the transmission gate 36 in response to the occurrence of output from the level detector 38 to pass the amplified sensor 14 voltage to a storage circuit 42 represented by a storage capacitor. The control pulse has a predetermined duration so that the capacitor is charged up to the input voltage during that duration where it remains until the occurrence of the next control pulse. The voltage at the output of storage circuit 42 is amplified by a variable gain amplifier 44 and applied to the inverting input terminal of the differential amplifier 34. The variable gain amplifier 44 may be comprised by a noninverting operational amplifier and a variable attenuator or resistor, which is adjusted so the voltage on the inverting input of differential amplifier 34 has a predetermined relation to the voltage on the noninverting input. Therefore, $V_1$ on curve *a* is represented by the voltage sampled at the instant the predetermined A/F ratio is reached and used as a reference with which the instantaneous voltage from the sensor 14 at any given instant of time is compared. This reference value is renewed with a voltage sampled by the next control pulse.

Assume that a change has occurred in performance characteristic of the sensor 14 due to a temperature variation causing curve *a* to drift to the left as indicated by broken-line curve *a'*, and the reference voltage has lowered to $V_2$. Since, in so far as the sensor 15 is concerned, the time of occurrence of the steep voltage transition is not substantially subject to change with temperature variations although some voltage change is observed on the high level side, the same output voltage can be obtained from the differential amplifier 34 as that obtained prior to the occurrence of the performance change with the sensor 14.

If the catalytic converter 16 consists of a three-way catalyst, NOx as well as oxidizing HC and CO are reduced provided that the air-fuel ratio is controlled within a narrow range near stoichiometry (at a ratio of 14.8). If the noxious emissions are reduced by separate converter units, the amplification gain of amplifier 44 is adjusted to set the reference voltage at a value other than the stoichiometric air-fuel ratio to give maximum conversion efficiency for particular noxious compositions. For example, by varying the amplification gain to increase voltage $V_1$ to $V_2$ as shown in FIG. 9*a*, the differential output curve *c* of FIG. 9*b* changes to curve *c'* of FIG. 9*c* which would be obtained if curve *b* of sensor 15 has shifted to the left as indicated by broken-line curve *b'*. Thus, the set A/F ratio at which the system is controlled has changed from *s*1 to *s*2.

The performance characteristics of the exhaust composition sensors are further subject to change with the elapse of operating time. The circuit shown in FIG. 3 is intended to compensate for a time-dependent error signal from the sensors 14 and 15 used in the arrangement of FIG. 1. In FIG. 3 potentiometers 46 and 48 are respectively connected between the output of amplifiers 28 and 30 and ground, with their wipers respectively connected to the noninverting and inverting input terminals of the differential amplifier 32. The wiper terminals of these potentiometers are operatively connected to an elapsed time of operation measuring device 50, for example, an odometer such that the movements of the wipers are so related with the reading of the odometer 50 that errors arising in the voltage on the wipers due to the elapse of operating time of composition sensors (which is also associated with the operating time of the engine 12) are compensated. Assume that the sensors 14 and 15 have undergone changes in performance such that their output characteristic curves have shifted in the same direction of change as indicated by broken-line curves *a'* and *b'*, respectively. In such case, the wipers of potentiometers 46, 48 are moved through the linkage with the odometer 50 in such manner that the voltage on the wiper of potentiometer 46 decreases with the result that curve *a'* has shifted to a position as indicated by solid-line curve *a*, while the voltage on the wiper of potentiometer 48 increases with the result that curve *b'* has shifted to a position as indicated by solid-line curve *b*. With these corrective actions, the system can be controlled at a prescribed air-fuel ratio which gives maximum conversion efficiency with a particular type of catalytic converter.

FIG. 4 is an illustration of a circuit in which the corrector 19 of FIG. 2 is modified to compensate for a time-dependent error introduced to the sensors 14 and 15 having characteristic curves of FIG. 8. The corrector 19 of FIG. 4 includes a potentiometer 52 connected between the output of amplifier 32 and ground with its wiper terminal connected to the noninverting input of differential amplifier 34. The wiper is so connected operatively through a linkage shown in dotted lines to an odometer 54. The output from the sensor 15 is connected to an amplifier 56 and applied to one input of a comparator 58, having a second input responsive to a reference voltage which is obtained from the wiper terminal of a potentiometer 60 connected in series with a resistor 62 between source voltage Vcc and ground. The wiper of potentiometer 60 is likewise operatively connected through a linkage shown in dotted lines with the odometer 54. As described in connection with the previous embodiments, the wipers of these potentiometers are so connected with the odometer 54 that their points of contact with the respective resistive elements changes as a function of operating time of the sensors. Assume that, in the initial period of operation, the sensor 15 having a sharp characteristic change in amplitude generates an output voltage of 400 mmV at stoichiometry as indicated by curve *a* of FIG. 11, and after travel of 50 km the output voltage has reduced to 300 mmV at the same stoichiometry as shown in curve *b*. During this length of operating time, the reference voltage at the comparator 58 input has reduced by 100 mmV at which the level detector 38 produces an output indicating that stoichiometry is reached by the corrective movement of the potentiometer 60 wiper. On the other hand, the error introduced into the sensor 14 having a gradually varying output characteristic is compensated by the corrective movement of potentiometer 52 wiper and the corrected voltage is sampled in a manner as previously described.

Figure 6:
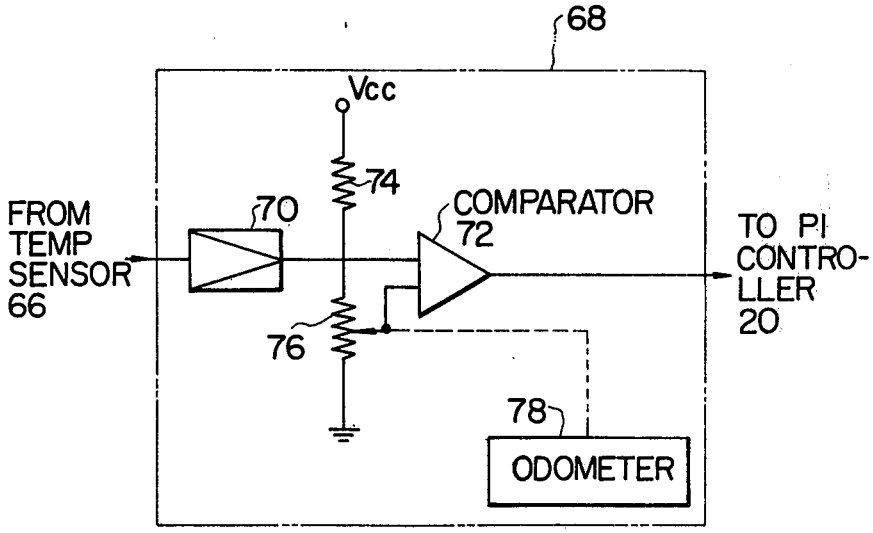
FIGS. 5 and 6 is an illustration of another embodiment of the invention.
Figure 5:
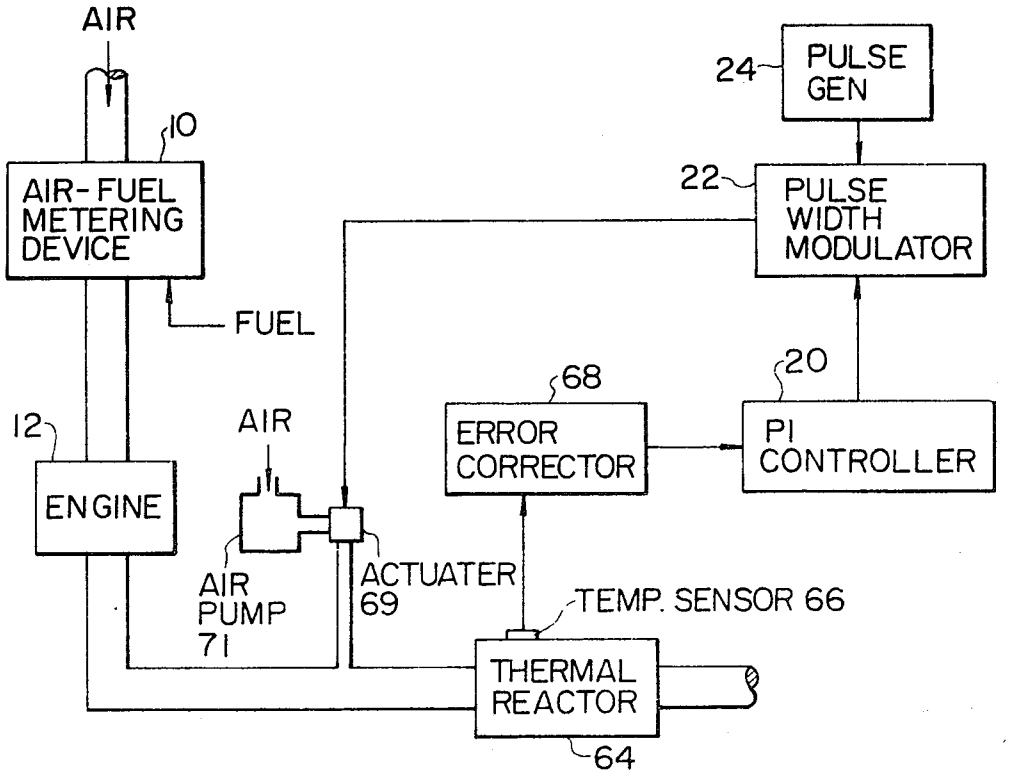

FIG. 5 illustrates another example in which a thermal reactor 64 is employed for reducing the noxious emissions. A temperature sensor 66 is attached to the wall of the reactor chamber to provide a corresponding electrical signal which is modulated in amplitude by the PI controller 20 and then converted into a train of pulses, with pulse duration being determined by the control signal. An actuator 69 is operated by the pulse to supply additional oxygen through an air pump 71 to the thermal reactor 64. An error corrector 68 is connected between the output of temperature sensor 66 and the input of the controller 20 to compensate for the error introduced to the output of temperature sensor 66 due to change in performance of the thermal reactor 64 with time. The corrector 68 is shown in FIG. 6 and comprises an amplifier 70 to provide amplification of the signal from temperature sensor 66 and apply it to one input of a comparator 72. A voltage divider includes a series-connected resister 74 and a potentiometer 76 connected between voltage source Vcc and ground. The reference voltage is obtained from the wiper terminal of the potentiometer 76 which is connected to the other input of comparator 72 and further operatively connected to the odometer 78. The connection between the odometer 78 and the wiper terminal permits the voltage on the wiper to change in relation to the operating time of the reactor in the same manner as described above. The comparator 72 produces an output when the amplifier output reaches the reference voltage. When this occurs, the PI controller 20 generates a control signal which is used to modulate the width of the pulse derived from the modulator 22. The active time of actuator 69 is thus determined by the width of the control pulse, and the thermal reactor 64 is supplied with an additional amount of oxygen necessary to reduce the noxious emissions. This feedback control keeps the reactor 64 at an optimum condition. With the elapse of operating time the reference voltage is controlled in accordance with a predetermined schedule built into the connection between the wiper of potentiometer 76 and the odometer 78 to compensate for the error introduced into the reactor performance during its operating time.

What is claimed is:

1. A mixture control system for an internal combustion engine, comprising first and second means for detecting an exhaust composition of the engine to generate signals of different amplitude and slope characteristics as a function of the air-fuel ratio of the mixture detected thereby, said detecting means comprising exhaust composition sensors at substantially the same location in the exhaust system of the engine, said sensors having a tendency to generate signals having errors in the detected composition arising from changes in the performance characteristics of the detecting means, and means responsive to and for combining the signals derived from the first and second composition detecting means to generate a signal substantially free from the errors arising from the changes in performance characteristics of the first and second composition detecting means.

2. A mixture control system for an internal combustion engine, comprising:

first means for generating a first signal representative of an exhaust composition of the engine of which the amplitude increases as the air-fuel ratio of the mixture increases;

second means for generating a second signal representative of an exhaust composition of the engine of which the amplitude decreases as the air-fuel ratio of the mixture increases;

the amplitude of the first and second signals having a tendency to change as a function of external conditions in opposite directions and having a common output level at a predetermined value of the air-fuel ratio;

means for comparing the amplitudes of the first and second signals to generate a signal representing the difference therebetween; and control circuit means for modulating the difference signal into a form suitable for controlling the air-fuel ratio of the mixture at said predetermined value prior to combustion.

3. A mixture control system as claimed in claim 2, wherein said first signal generating means comprises a first exhaust composition sensor having an output characteristic which increases as the air-fuel ratio increases, said second signal generating means comprises a second exhaust composition sensor having an output characteristic which decreases as the air-fuel ratio increases, and means for adjusting the relative values of the outputs from the first and second sensors so that a common output signal is delivered from the first and second sensors at a predetermined air-fuel ratio.

4. A mixture control system as claimed in claim 3, further comprising means for recording the length of operating time of the engine, and means for varying the amplitude of the outputs from the first and second sensors in response to the recorded length of time so that errors which might have been introduced to the performance characteristics of the first and second sensors during said recorded time are compensated.

5. The mixture control system of claim 1 wherein the first exhaust composition sensor has a gradually changing output characteristic as a function of the air-fuel ratio of the mixture; the second exhaust composition sensor has a rapidly changing output characteristic at a predetermined value of the air-fuel ratio; said combining means including:

means for sampling the output of the first sensor when said second sensor changes its output level and for holding the sampled output until the next change occurs at the output of the second sensor, and means for comparing the instantaneous value of the output from the first sensor with the sampled output to generate an output representing the difference between said outputs compared.

6. A mixture control system as claimed in claim 5, wherein said means for sampling the output level comprises means for detecting the change in output level of the second sensor, a storage circuit, and means for passing the output of the first sensor to said storage circuit upon the detection of the change in output level of the second sensor.

7. A mixture control system as claimed in claim 6, further comprising means connected to said storage circuit to control the magnitude of the stored output of the first sensor with respect to the instantaneous value of the output from the first sensor.

8. A mixture control system as claimed in claim 6, further comprising a comparator having first input connected to the second sensor and a second input connected to a source of variable voltage, and means for detecting the length of operating time of the engine and controlling said variable voltage in relation to the detected length of time, the comparator generating an output only when said controlled variable voltage is reached and the output from the comparator being connected to said level detecting means.

9. A mixture control system as claimed in claim 5, further comprising variable gain amplifier means connected between the first sensor and the comparing means and means for detecting the length of operating time of the engine and controlling the output of the amplifier means in relation to the detected length of time.

10. The system of claim 5 further including control circuit means for modulating the difference output into a form suitable for controlling the air-fuel ratio of the mixture at said predetermined value prior to combustion.

11. The system of claim 1 further including means responsive to the substantially error-free signal to control the mixture at a predetermined air-fuel ratio.

12. The system of claim 1 wherein the signals derived by the sensors have characteristics with oppositely directed slopes.

13. The system of claim 12 wherein the slopes have values on the same order of magnitude in a region where the characteristics intersect.

14. The system of claim 1 wherein the signal derived by one of the sensors has a characteristic with a slope much greater than the signal derived by the other sensor in a region where the characteristics intersect.

* * * * *